US007553142B2

(12) United States Patent
Zinsmeyer et al.

(10) Patent No.: US 7,553,142 B2
(45) Date of Patent: Jun. 30, 2009

(54) LUBRICATION SYSTEM FOR COMPRESSOR

(75) Inventors: Thomas M. Zinsmeyer, Pennellville, NY (US); Stephen L. Shoulders, Baldwinsville, NY (US)

(73) Assignee: Carrier Corporation, Syracuse, NY (US)

( * ) Notice: Subject to any disclaimer, the term of this patent is extended or adjusted under 35 U.S.C. 154(b) by 429 days.

(21) Appl. No.: 10/786,688

(22) Filed: Feb. 25, 2004

(65) Prior Publication Data

US 2005/0186095 A1 Aug. 25, 2005

(51) Int. Cl.
*F03C 2/00* (2006.01)
*F03C 4/00* (2006.01)
*F04C 15/00* (2006.01)

(52) U.S. Cl. ..... 418/84; 418/98; 418/201.1

(58) Field of Classification Search ..... 418/87, 418/88, 97, 98, 201.1, 201.2, 84; 184/7.4
See application file for complete search history.

(56) References Cited

U.S. PATENT DOCUMENTS 2,505,595 A * 4/1950 Warren ..... 418/87
3,260,444 A * 7/1966 Williams et al. ..... 418/88
3,975,123 A * 8/1976 Schibbye ..... 418/97
4,173,440 A * 11/1979 Libis ..... 418/98
4,179,248 A 12/1979 Shaw
4,758,136 A 7/1988 Pamlin et al.
5,134,856 A 8/1992 Pillis et al.
5,236,320 A 8/1993 Oishi et al.
5,350,286 A 9/1994 Kisi et al.
5,411,385 A * 5/1995 Eto et al. ..... 418/96
6,059,551 A 5/2000 Amano et al.
6,095,780 A * 8/2000 Ernens ..... 418/201.1

FOREIGN PATENT DOCUMENTS

JP 59231189 A * 12/1984 ..... 418/87

* cited by examiner

*Primary Examiner*—Theresa Trieu
(74) *Attorney, Agent, or Firm*—Carlson, Gaskey & Olds

(57) ABSTRACT

A compressor of this invention includes a flow passage supplying lubricant to an outlet bearing and to an inlet bearing. An orifice is disposed within the flow passages for controlling lubricant flow to the bearing assemblies. A choke orifice is disposed in series with one of the orifices for either the inlet or outlet for controlling lubricant flow relative to the other orifice.

16 Claims, 3 Drawing Sheets

LUBRICATION SYSTEM FOR COMPRESSOR

BACKGROUND OF THE INVENTION

This invention generally relates to a compressor and specifically to a lubrication control system for a screw compressor.

Typically, a screw compressor includes screws that have mated helical teeth. The helical teeth engage during rotation to form a space therebetween. The space between the teeth progressively decreases between an inlet and outlet. Rotation of the screws draws low-pressure gas from an inlet into the space between the teeth and progressively compresses the gas. The compressed gas is released through an outlet opening in communication with an end of the screws.

Each of the screws is supported at the inlet and outlet ends by bearing assemblies. These bearing assemblies are supported within cavities of the compressor housing and supplied with lubricant from an oil pump through a plurality of passageways. The oil pump provides a desired lubricant pressure and flow at each bearing assembly. Orifices in flow passages to each bearing assembly are sized such that lubricant flow is governed to a desired amount at each bearing assembly. Such configurations operate acceptably for compressors where both inlet and outlet bearing assemblies require the same magnitude of lubricant flow.

However, in compressors where the inlet and outlet bearing assemblies require different magnitudes of lubricant flow, individual sizing of inlet and outlet orifices is not desirable. Utilizing different size orifices to obtain the desired lubricant flow at each inlet and outlet bearing is more difficult to manufacture and increases complexity in order to ensure that the correct orifice is installed at each location. In most cases, the inlet bearing assemblies require a lower flow rate than the outlet bearing assemblies. The resulting orifices required to reduce lubricant flow rate for the inlet bearing assemblies are relatively small as compared to orifices for the outlet bearing assemblies. Small orifices can provide the decrease in flow required, however, smaller orifices are susceptible to clogging due to debris within the lubricant. Simply, lowering the overall system lubricant flow rate is not a practical solution because such a reduction in overall lubricant flow can potentially cause control problems. Further, increasing overall lubricant flow in combination with the use of larger openings is not a desirable alternative because of the possibility of overloading the oil reclamation system.

Accordingly, it is desirable to develop a lubricant pressure control system for a compressor that provides desired lubricant flows at the inlet bearing and the outlet bearing without increasing complexity or creating potential system control problems.

SUMMARY OF INVENTION

A compressor assembly of this invention includes a choke orifice within a lubricant flow passage for controlling a lubricant flow rate to an inlet bearing independent of a lubricant flow rate to an outlet bearing.

The compressor assembly includes inlet bearing assemblies and outlet bearing assemblies that support each end of mated screws. Each of the inlet and outlet bearing assemblies is supported within a cavity of a compressor housing. Each cavity is in flow communication with a lubricant flow passage that contains an orifice. An oil pump pumps lubricant from an oil reservoir to each of the cavities. Each of the orifices in each flow passage to each cavity are of a common size.

The flow passage includes a primary portion, an inlet portion and an outlet portion. The inlet bearing assemblies require only a portion of the lubricant flow required by the outlet bearing assemblies. A choke orifice is disposed between the primary portion of the flow passage and the inlet bearing assemblies. The choke orifice decreases lubricant flow within the inlet portion such that the inlet bearing assemblies are provided with the desired level of lubricant flow.

Accordingly, the compressor of this invention provides a lubricant flow control system that controls lubricant flows at the inlet bearing assemblies independent of lubricant flow at the outlet bearing assemblies without increasing system complexity or the potential for system control problems.

The various features and advantages of this invention will become apparent to those skilled in the art from the following detailed description of the currently preferred embodiment.

The drawings that accompany the detailed description are briefly described below.

DETAILED DESCRIPTION OF THE PREFERRED EMBODIMENT

Figure 1:
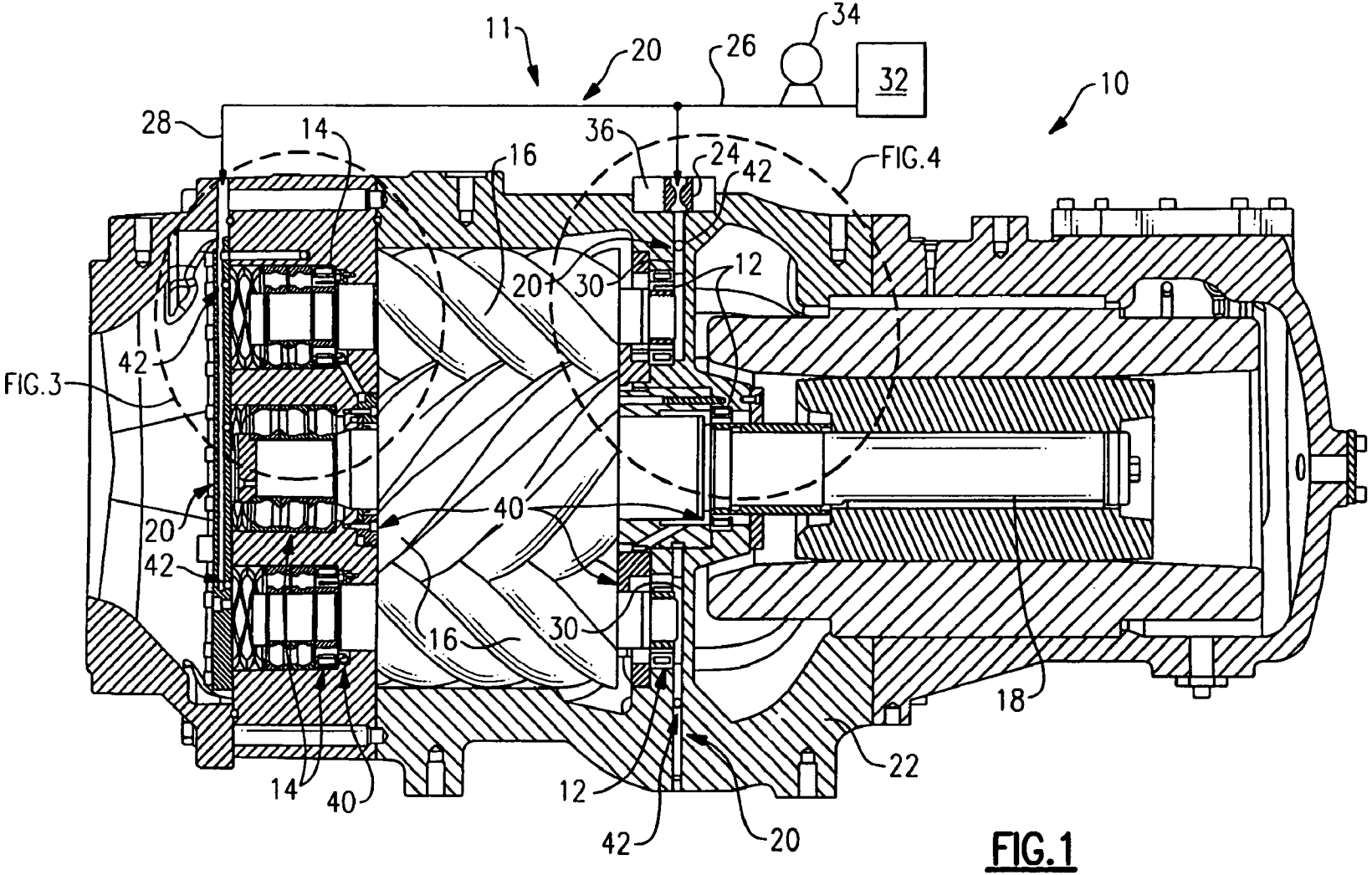
FIG. 1 is a schematic cross-section of a compressor according to this invention.

Referring to FIG. 1, a screw compressor assembly 10 including inlet bearing assemblies 12 and outlet bearing assemblies 14 is shown. The inlet and outlet bearing assemblies 12, 14 support rotation of screw rotors 16 driven by a motor 18. The inlet bearing assemblies 12 include roller bearings and the outlet bearing assemblies include either ball bearings or a combination of ball and roller bearings. The specific configuration of the bearing assemblies is application specific and a worker with the benefit of this disclosure would understand that various other known bearing configurations would benefit from the application of this invention.

A lubrication system 11 within the compressor assembly 10 includes flow passages 20 that supply lubricant to the inlet and the outlet bearing assemblies 12,14. Note that some of the flow passages 20 are not visible in cross-section and are shown schematically. More specifically, each of the inlet and outlet bearing assemblies 12,14 is supported within a compressor housing 22. Although a screw compressor is shown a worker with the benefit of this disclosure would understand that this invention is applicable to compressors of any known configuration.

The flow passages 20 include a choke orifice 24 for controlling lubricant flow to at least one of the inlet and outlet bearing assemblies 12,14. The inlet bearing assemblies 12 require only about $1/5^{th}$ the lubricant flow as is required by the outlet bearing assemblies 14. The choke orifice 24 provides the desired pressure drop to reduce the flow of lubricant to the inlet bearing assemblies 12.

The flow passage 20 includes a primary portion 26, an outlet portion 28 and an inlet portion 30. The choke orifice 24 is disposed within the inlet portion 30 to provide the desired lubricant flow to the inlet bearing assemblies 12. The flow passages 20 communicate lubricant from a lubricant supply reservoir 32 and oil pump 34.

The flow passage 20 is partially shown schematically in FIG. 1, and partially shown as a cross-section through the compressor housing 22. As appreciated, the specific configuration and location of the flow passages 20 accommodates the features of the compressor 10. Further, the flow passage 20 can include a series of tubes or hoses that run external to the compressor assembly 10.

The choke orifice 24 is mounted within a lube block 36 and is mounted to the compressor housing 22. The lube block 36 includes various flow passages for directing lubricant from the oil reservoir 32 to flow passages within the compressor housing 22. The lube block 36 is mounted to the compressor housing and is in communication with flow passages within the compressor housing 22.

The choke orifice 24 can be mounted within the lube block 36 by any means known to worker skilled in the art. For example, the choke orifice 24 can include threads, and be threaded into the lube block 36. Further, the choke orifice 24 can be pressed into the lube block 36. Additionally, a worker with the benefit of this disclosure will understand that the choke orifice 24 can be mounted anywhere between the inlet bearing assemblies 12 and the primary portion 26 of the flow passage 20. The choke orifice 24 is provided to control the flow of lubricant supplied to the inlet bearing assemblies 12, and therefore maybe mounted anywhere within the compressor housing 22 or flow passages 20 leading to the inlet bearing assemblies 12.

Figure 2:
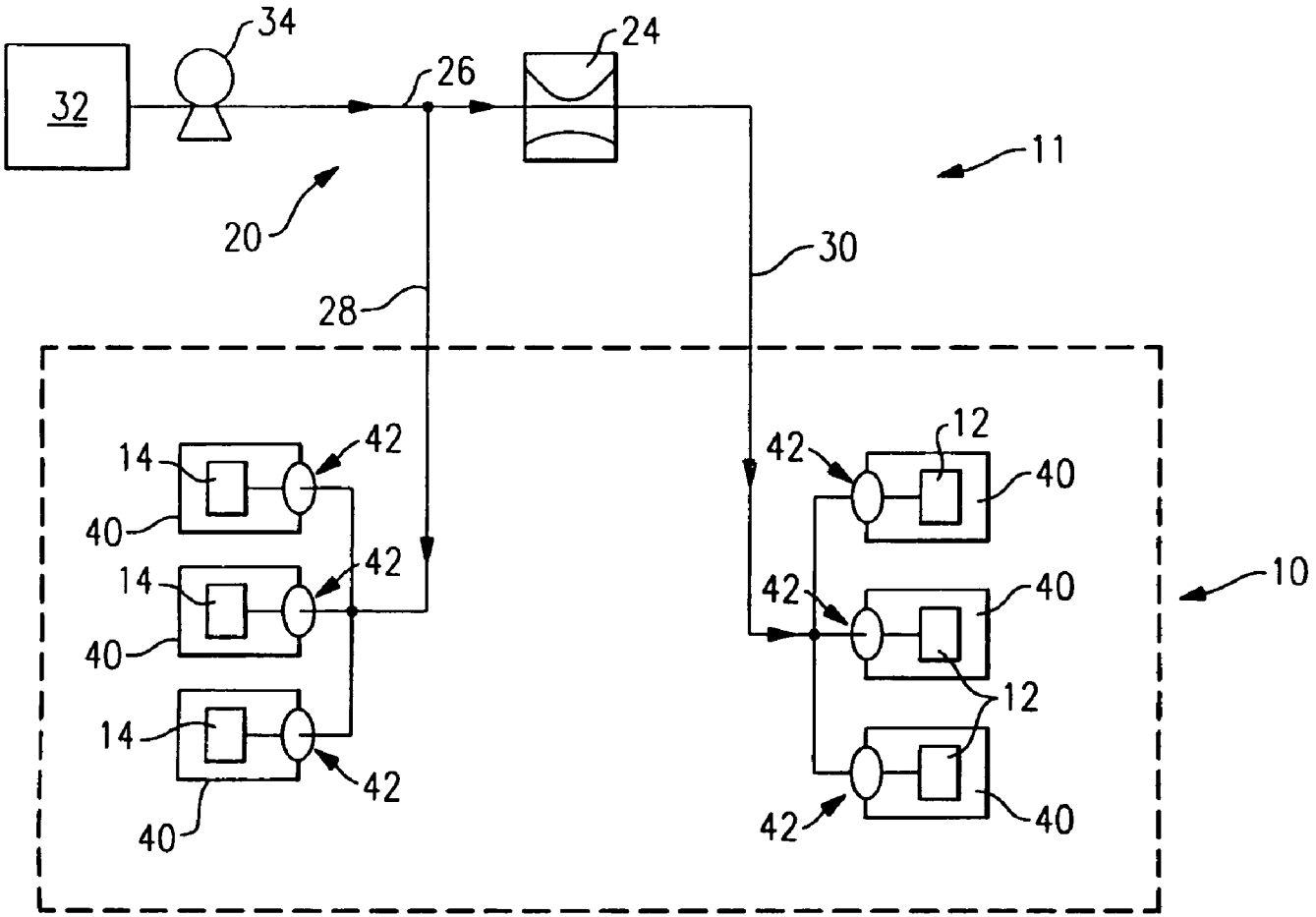
FIG. 2 is a schematic illustration of the lubricant control system of this invention.

Referring to FIG. 2, a schematic illustration of the lubrication system 11 is shown and includes three inlet bearing assemblies 12 and three outlet bearing assemblies 14. Each of the bearing assemblies 12,14 is mounted within a cavity 40. Each cavity 40 is defined within the compressor housing 22. The flow passage 20 includes the primary portion 26 that branches into the outlet portion 28 and inlet portion 30. Lubricant flow within the primary portion 26 is the sum of lubricant flow rates in outlet portion 28 and inlet portion 30. The inlet portion 30 of flow passages 20 includes a flow passage branching from primary portion 26 leading to choke orifice 24, the flow passage through orifice 24, three passages leading to orifices 42, flow passages through each orifice 42, and passages from each orifice 42 to each bearing cavity 40 containing a inlet bearing assembly 12. The inlet portion 30 includes lubricant at a reduced flow rate as is dictated by the specific size of the choke orifice 24 in concert with the size of the inlet portion 30 of the flow passage 20.

Lubricant flow rate in inlet portion 30 is determined by flow-restricting action of choke orifice 24 in concert with flow-restricting action of orifices 42. The example passages supplying oil flow to each of the flow-restricting orifices 42 include a larger flow area a flow area through the orifices 42. Preferably, the choke orifice 24 is sized to provide $1/5^{th}$ the lubricant flow that is supplied to the outlet bearing assemblies 14. As appreciated, other relationships of lubricant flow between the outlet and inlet bearing assemblies 12, 14, can be accommodated by properly sizing the choke orifice 24.

At least one orifice 42 is disposed within the flow passage before each bearing. The size of the orifices 42 within cavities for both the inlet and outlet bearing assemblies 12,14 is the same. The common opening size for each of the bearing assemblies 12,14 substantially simplifies manufacturing and assembly by eliminating the potential for confusion or error.

Figure 3:
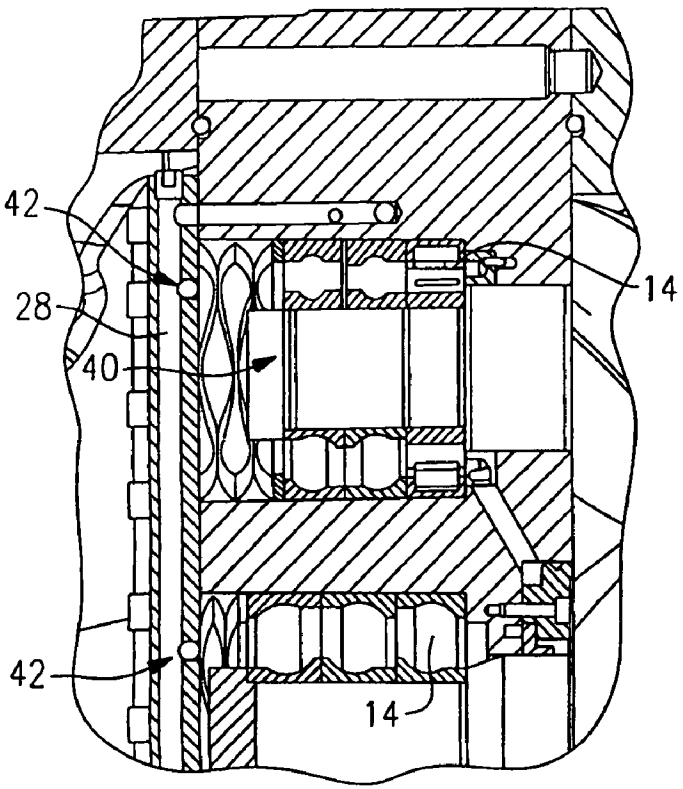
FIG. 3 is a cross-section of a outlet bearing cavity and bearing.

Referring to FIG. 3, a portion of the outlet bearing assemblies 14 and part of outlet portion 28 of flow passage 20 are shown. Outlet portion 28 includes flow passages through orifices 42, through which lubricant flows to each bearing cavity 40.

Figure 4:
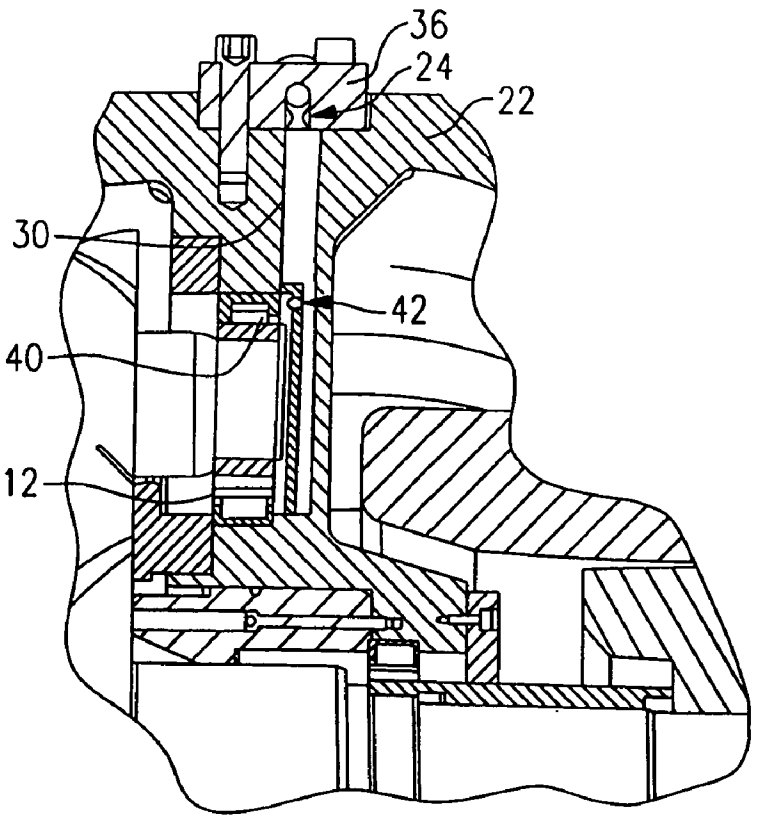
FIG. 4 is a cross-section of a inlet bearing cavity and bearing.

Referring to FIG. 4, one of the inlet bearing assemblies 12 within a bearing cavity 40 and part of inlet portion 30 of flow passage 20 are shown. Inlet portion 30 includes flow passages through orifices 42. Each orifice 42 in inlet portion 30 is in flow communication with a portion of the flow passage 20 defined within the compressor housing 22 leading to a cavity 40 containing an inlet bearing assembly 12. The orifices 42 in inlet portion 30 are disposed downstream of the choke orifice 24. The choke orifice 24 in combination with the orifices 42 in inlet portion 30 provides the desired flow to each of the inlet bearing assemblies 12. Orifices 42 in outlet portion 28 provide the desired flows to each of the outlet bearing assemblies 14. The sizes of orifices 42 are selected to provide the desired amount of lubricant flow. The size of the choke orifice 24 is selected so that each inlet bearing assembly 12 receives $1/5^{th}$ the lubricant flow that is supplied to each outlet bearing assembly 14. The use of the choke orifice 24 to provide the preferred flow rate to inlet bearings provides for a common orifice flow passage size to be used for all orifices 42.

The compressor of this invention includes the lubrication control system that includes a choke orifice for proportionally allocating lubricant between the inlet and outlet bearing assemblies. The proportional allocation provides optimal lubrication for each of the bearing assemblies, without complicating manufacture and assembly by using orifices with flow passages of different sizes. Furthermore, while the preferred lower flow rates to inlet bearings could be achieved by using orifices in inlet portion 30 that have smaller sized flow passages than orifices in outlet portion 28, the passage sizes required would be so small that they would be prone to clogging by debris entrained in the lubricant flow. In contrast, the orifice sizes required to achieve preferred flow rates when a choke orifice is used are larger and therefore less prone to clogging by debris.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A compressor assembly comprising:

an inlet bearing supplied with lubricant through an inlet orifice;

an outlet bearing supplied with lubricant through an outlet orifice;

a rotating compressor member supported for rotation on an inlet end by said inlet bearing and on an outlet end by said outlet bearing;

a plurality of flow passages for supplying lubricant to said inlet and outlet orifices; and a choke orifice disposed in series with said inlet orifice for changing a lubricant flow rate to the inlet bearing relative to a lubricant flow rate to the outlet bearing from said outlet orifice, wherein each of the choke orifice, the inlet orifice and the outlet orifice comprise a flow area substantially smaller than any of the plurality of flow passages.

2. The assembly as recited in claim 1, wherein said inlet orifice and said outlet orifice are of a common size.

3. The assembly as recited in claim 2, wherein said flow passages comprise a primary portion feeding lubricant to an inlet portion and an outlet portion.

4. The assembly as recited in claim 1, wherein a flow rate of lubricant to said inlet orifice is lower than a flow rate of lubricant to said outlet orifice.

5. The assembly as recited in claim 1, wherein said compressor assembly comprises a screw compressor.

6. The assembly as recited in claim 1, comprising a lube block defining a portion of said flow passage, wherein said choke orifice is disposed within said lube block.

7. The assembly as recited in claim 1, wherein a portion of said flow passage comprises tubing mounted to said compressor.

8. A screw compressor assembly comprising:

a motor driving screw rotors;

an outlet bearing supporting an outlet side of said screw rotors;

an inlet bearing supporting an inlet side of said screw rotors;

a flow passage comprising an inlet orifice for supplying lubricant to said inlet bearing, an outlet orifice for supplying lubricant to said outlet bearing; and a choke orifice in series with said inlet orifice for controlling the flow of lubricant to said inlet orifice relative to the flow of lubricant to the outlet orifice, wherein the flow passage comprises a substantially larger flow area than any of said choke orifice, said inlet orifice and said outlet orifice.

9. The assembly as recited in claim 8, wherein said inlet orifice and said outlet orifice are of a common size.

10. The assembly as recited in claim 9, wherein said flow passage comprises a primary portion feeding lubricant to an inlet portion and an outlet portion.

11. The assembly as recited in claim 8, comprising a lube block defining a portion of said flow passage, wherein said choke orifice is disposed within said lube block.

12. The assembly as recited in claim 8, comprising three inlet and outlet bearing assemblies, and three inlet and outlet orifices, wherein said choke orifice is in series with said three inlet orifices.

13. The assembly as recited in claim 12, wherein a lubricant flow rate to said inlet bearing assemblies is less than a lubricant flow rate to said outlet bearing assemblies.

14. The assembly as recited in claim 13, wherein said lubricant flow rate to said inlet bearing assemblies is no more than $1/5^{th}$ said lubricant flow rate to said outlet bearing assemblies.

15. A screw compressor assembly comprising:

a motor driving screw rotors;

an outlet bearing supporting an outlet side of said screw rotors;

an inlet bearing supporting an inlet side of said screw rotors;

an inlet orifice for supplying lubricant to said inlet bearing;

an outlet orifice for supplying lubricant to said outlet bearing;

a primary portion including a primary passage for feeding lubricant to an inlet portion and an outlet portion; and a choke orifice in series with said inlet orifice for controlling the flow of lubricant to said inlet orifice, wherein said choke orifice is disposed within said inlet portion and a flow area of each of the choke orifice, the inlet orifice and the outlet orifice is substantially smaller than any portion of said primary passage.

16. The assembly as recited in claim 15, wherein a flow rate of lubricant within said inlet portion is lower than a flow rate of lubricant within said primary portion.

* * * * *